US011383140B2

(12) United States Patent
Lundin

(10) Patent No.: US 11,383,140 B2
(45) Date of Patent: Jul. 12, 2022

(54) GOLF FLAGSTICK ASSEMBLIES AS WELL AS COMPONENTS THEREFOR AND METHODS OF CONSTRUCTION

(71) Applicant: Craig A. Lundin, Commerce, MI (US)

(72) Inventor: Craig A. Lundin, Commerce, MI (US)

( * ) Notice: Subject to any disclaimer, the term of this patent is extended or adjusted under 35 U.S.C. 154(b) by 0 days.

(21) Appl. No.: 16/860,921

(22) Filed: Apr. 28, 2020

(65) Prior Publication Data

US 2020/0254316 A1 Aug. 13, 2020

Related U.S. Application Data

(60) Provisional application No. 62/854,606, filed on May 30, 2019, provisional application No. 62/840,007, filed on Apr. 29, 2019.

(51) Int. Cl.
*A63B 57/00* (2015.01)
*A63B 57/30* (2015.01)
*A63B 57/40* (2015.01)

(52) U.S. Cl.
CPC ..... *A63B 57/357* (2015.10); *A63B 57/40* (2015.10)

(58) Field of Classification Search
CPC ..... A63B 57/357; A63B 57/40
USPC ..... 473/176
See application file for complete search history.

(56) References Cited

U.S. PATENT DOCUMENTS 4,161,723 A * 7/1979 De Vittori ..... E01F 9/685 340/323 R
4,270,873 A * 6/1981 Laehy ..... E01F 9/629 256/1
4,926,785 A * 5/1990 Lamson ..... E04H 12/2215 116/209
5,005,512 A * 4/1991 Fu ..... E04H 12/182 116/173
5,303,931 A * 4/1994 Brown ..... A63B 63/00 116/173
6,099,412 A * 8/2000 Weibye ..... E01F 15/0469 473/150
7,004,104 B1 * 2/2006 Kundus ..... G09F 17/00 116/173
2005/0272515 A1 * 12/2005 Hurley ..... G09F 17/00 473/173
2009/0193700 A1 * 8/2009 Flannery ..... G09F 7/00 40/608
2010/0031546 A1 * 2/2010 Nwatu ..... G09F 15/0062 40/607.1

* cited by examiner

*Primary Examiner* — Nini F Legesse
(74) *Attorney, Agent, or Firm* — Matthew P. Dugan

(57) ABSTRACT

A golf flagstick assembly includes a ferrule, a first flagstick portion, a second flagstick portion and a connector fitting. The first flagstick portion has a first cross-sectional dimension. The second flagstick portion is separate from the first flagstick portion and has a second cross-sectional dimension. The second flagstick portion is oriented such that an end of the second flagstick portion is disposed toward an end of the first flagstick portion. The connector fitting extends between and operatively connect the first and second flagstick portions. The connector fitting has a fitting cross-sectional dimension that is less than the first cross-sectional dimension of the first flagstick portion and less than the second cross-sectional dimension of the second flagstick portion. Connector fittings and methods of assembly are also included.

20 Claims, 13 Drawing Sheets

GOLF FLAGSTICK ASSEMBLIES AS WELL AS COMPONENTS THEREFOR AND METHODS OF CONSTRUCTION

This application claims the benefit of priority to U.S. Provisional Patent Application Ser. No. 62/840,007, filed on Apr. 29, 2019 and U.S. Provisional Patent Application Ser. No. 62/854,606, filed on May 30, 2019, the entire contents of each of which is hereby incorporated herein by reference in its entirety.

BACKGROUND

The subject matter of the present disclosure broadly relates to the art of sports equipment and, more particularly, to flagstick assemblies used in connection with the playing of golf. Components for adapting existing flagsticks as well as methods of assembly and modification are also included.

Traditionally, the rules of golf have dictated that an associated golf ball played while on a putting green cannot contact a flagstick located within the target hole without the player incurring a penalty. As a result, the flagstick is typically removed from the target hole prior to or during the act of putting an associated golf ball from a starting position on the green.

Recently, in an effort to increase pace of play or for other reasons, one or more of the bodies governing the rules of golf have decided to alter this longstanding rule and allow an associated golf ball to be putted into the target hole without penalty while the flagstick remains therein. A debate currently exists as to whether an associated golf ball entering a target hole with the flagstick therein will provide an advantage or a disadvantage to the player. That is, there is conflicting evidence as to whether an associated golf ball contacting a flagstick that is within the target hole will increase or decrease the likelihood of the associated golf ball falling into the target hole. In any case, and whether such a rule change may create an advantage or disadvantage for the players, it has been observed that in many cases only a small amount of clearance exists for a putted golf ball to enter a target hole while the flagstick remains therein.

Notwithstanding the ongoing usage of existing flagstick constructions in connection with the playing of golf, the foregoing and/or other disadvantages exist that remain to be addressed. Accordingly, it is believed desirable to develop constructions, components and methods that overcome the foregoing and/or other problems and/or disadvantages of known designs, and/or otherwise advance the art of golf flagsticks.

BRIEF DESCRIPTION

One example of a golf flagstick assembly in accordance with the subject matter of the present disclosure can be dimensioned to be supported within an associated base located within an associated target hole. The golf flagstick assembly can have a longitudinal axis and can include a ferrule, a first flagstick portion, a second flagstick portion and a connector fitting. The ferrule can be dimensioned to operatively engage the associated base. The first flagstick portion can include a first end operatively connected to the ferrule and a second end spaced apart from the ferrule. The first flagstick portion can have a first cross-sectional dimension transverse to the longitudinal axis. The second flagstick portion can include a first end and a second end spaced apart from the first end. The second flagstick portion can be separate from the first flagstick portion and can have a second cross-sectional dimension transverse to the longitudinal axis. The second flagstick portion can be oriented such that the first end of the second flagstick portion is disposed toward the second end of the first flagstick portion. The connector fitting can extend between and operatively connect the first and second flagstick portions. The connector fitting can have a fitting cross-sectional dimension transverse to the longitudinal axis that is less than the first cross-sectional dimension of the first flagstick portion and less than the second cross-sectional dimension of the second flagstick portion.

One example of a golf flagstick connector fitting in accordance with the subject matter of the present disclosure can be dimensioned for securement between an associated first flagstick portion and an associated second flagstick portion. The connector fitting can include a fitting body having a longitudinal axis and extending longitudinally between a first end and a second end opposite the first end. The fitting body can include a first connector portion, a second connector portion and an extension portion. The first connector portion can be disposed along the first end of the fitting body and can have a first cross-sectional dimension in a direction transverse to the longitudinal axis. The first connector portion can be dimensioned for operative connection to the associated first flagstick portion. The second connector portion can be disposed along the second end of the fitting body and can have a second cross-sectional dimension transverse to the longitudinal axis. The second connector portion can be dimensioned for operative connection to the associated second flagstick portion. The extension portion can extend longitudinally between and operatively connect the first and second connector portions. The extension portion can have an extension cross-sectional dimension transverse to the longitudinal axis that is less than the first cross-sectional dimension of the first connector portion and less than the second cross-sectional dimension of the second connector portion.

One example of a method of assembling a golf flagstick in accordance with the subject matter of the present disclosure can include providing a first flagstick portion and a second flagstick portion that is separate from the first flagstick portion. The first flagstick portion can have a first cross-sectional dimension and the second flagstick portion can have a second cross-sectional dimension. The method can also include providing a connector fitting including a first connector portion, a second connector portion, and an extension portion extending longitudinally between and operatively connecting the first and second connector portions. The extension portion can have an extension cross-sectional dimension that is less than the first cross-sectional dimension of the first flagstick portion and less than the second cross-sectional dimension of the second flagstick portion. The method can further include securing the first flagstick portion to the first connector portion of the connector fitting, and/or can include securing the second flagstick portion to the second connector portion of the connector fitting such that the extension portion is positioned lengthwise between the first and second flagstick portions.

DETAILED DESCRIPTION

Turning now to the drawings, it is to be understood that the showings are for purposes of illustrating examples of the subject matter of the present disclosure and are not intended to be limiting. Additionally, it will be appreciated that the drawings are not to scale and that portions of certain features and/or elements may be exaggerated for purpose of clarity and ease of understanding.

Figure 1:
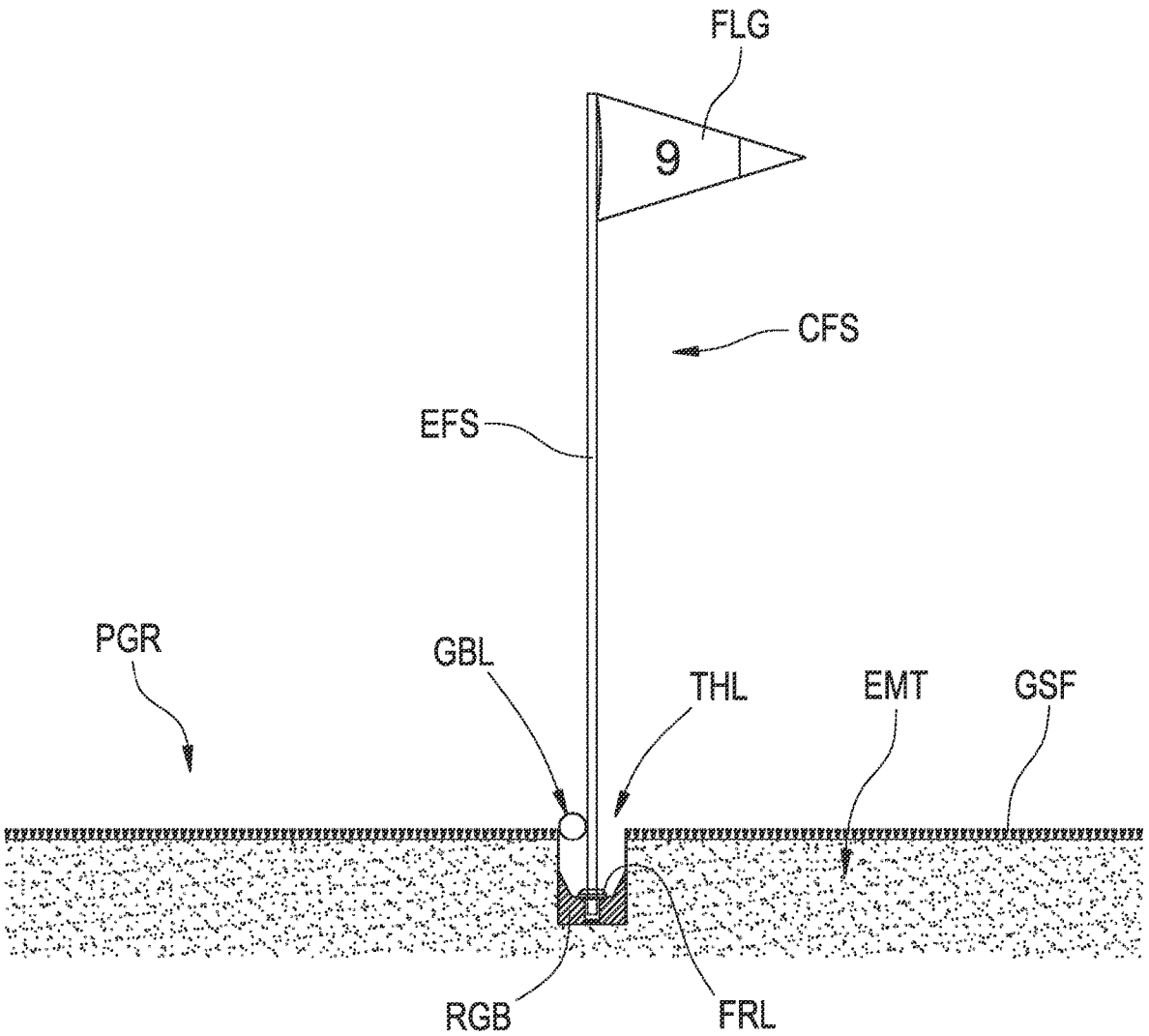
FIG. 1 is a side elevation view of a conventional golf green having a conventional target hole with an associated golf ball entering the target hole while a conventional flagstick assembly is supported therein.
Figure 3:
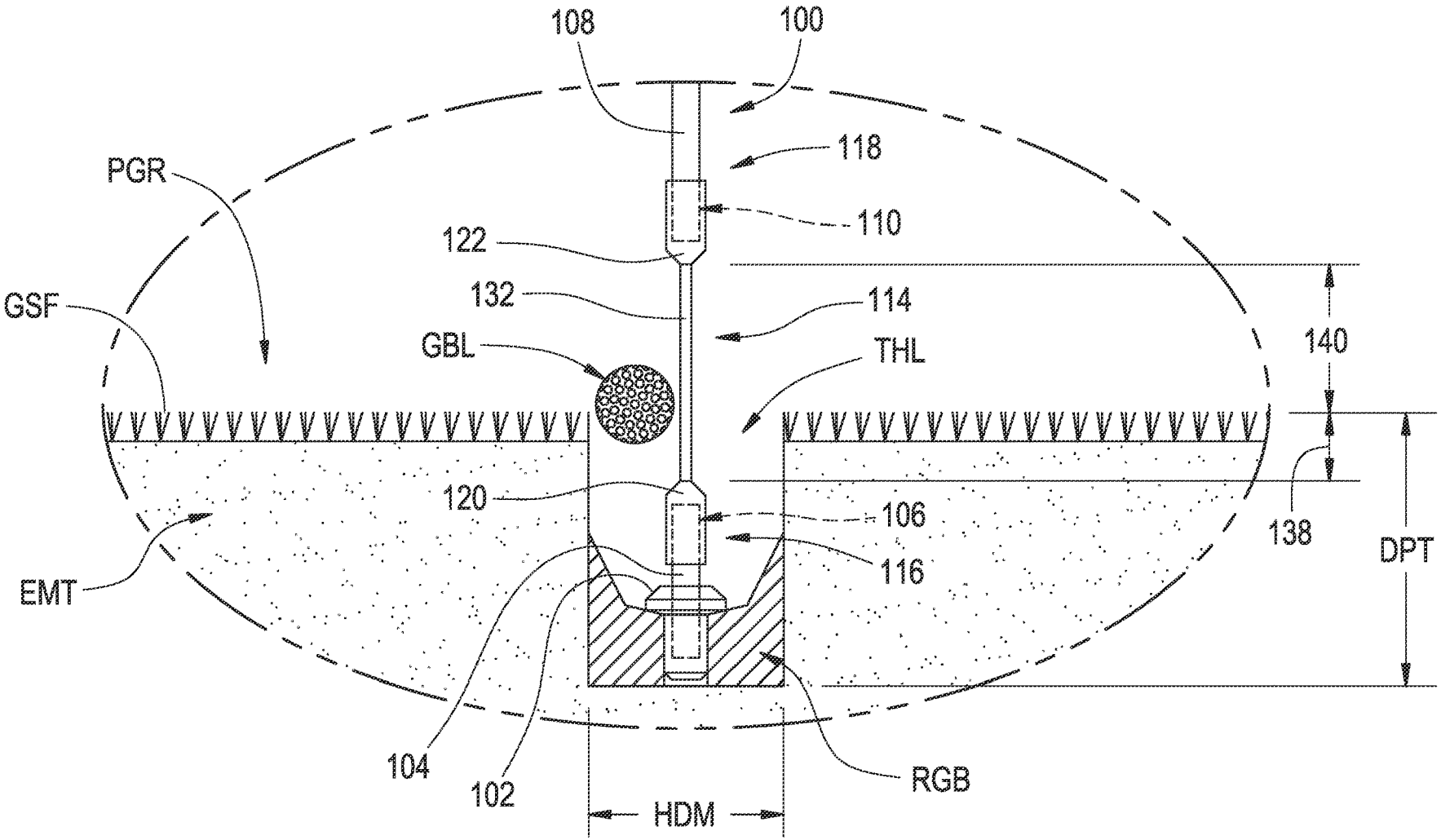
FIG. 3 is an enlarged view of the portion of the golf green and flagstick assembly identified as Detail 3 in FIG. 2.

FIG. 1 illustrates an area of a golf course commonly referred to as a putting green PGR that includes a target hole THL into which a golf ball GBL is played in an otherwise conventional manner. The target hole is typically cut into the putting green such that the hole extends through the grass surface GSF and into the earthen material EMT below by a certain generally standardized depth, which is represented in FIG. 3 by reference dimension DPT. Target hole THL will also typically have a standardized shape (e.g., cylindrical) and size (e.g., 4.25 inches), as is represented in FIG. 3 by reference dimension HDM. Typically, a rigid base RGB is placed into the target hole and is supported at the bottom thereof. Conventionally, the rigid base will include one or more features suitable for receiving and retaining a flagstick that identifies target hole THL and can usually be seen at a significant distance away from the putting green. A conventional flagstick CFS is shown in FIG. 1 and includes an elongated flagstick segment EFS with a ferrule FRL secured along one end and a flag FLG supported at a distance above grass surface GSF.

As indicated above, target hole THL typically has a standardized shape and size. Similarly, golf ball GBL will have a lower size limit of 1.68 inches in diameter though larger diameter sizes could be used. It has been found that many flagsticks have a round cross-sectional shape and are approximately 0.50 inches in diameter in the area in which the flagstick enters the target hole. In cases in which golf ball GBL is played toward target hole THL with conventional flagstick CFS in place in the target hole, only a small amount of clearance (e.g., approximately 0.19 inches) is available between the edge of the target hole and the outer surface of elongated flagstick segment EFS for the full diameter of the golf ball to fit through.

Figure 2:
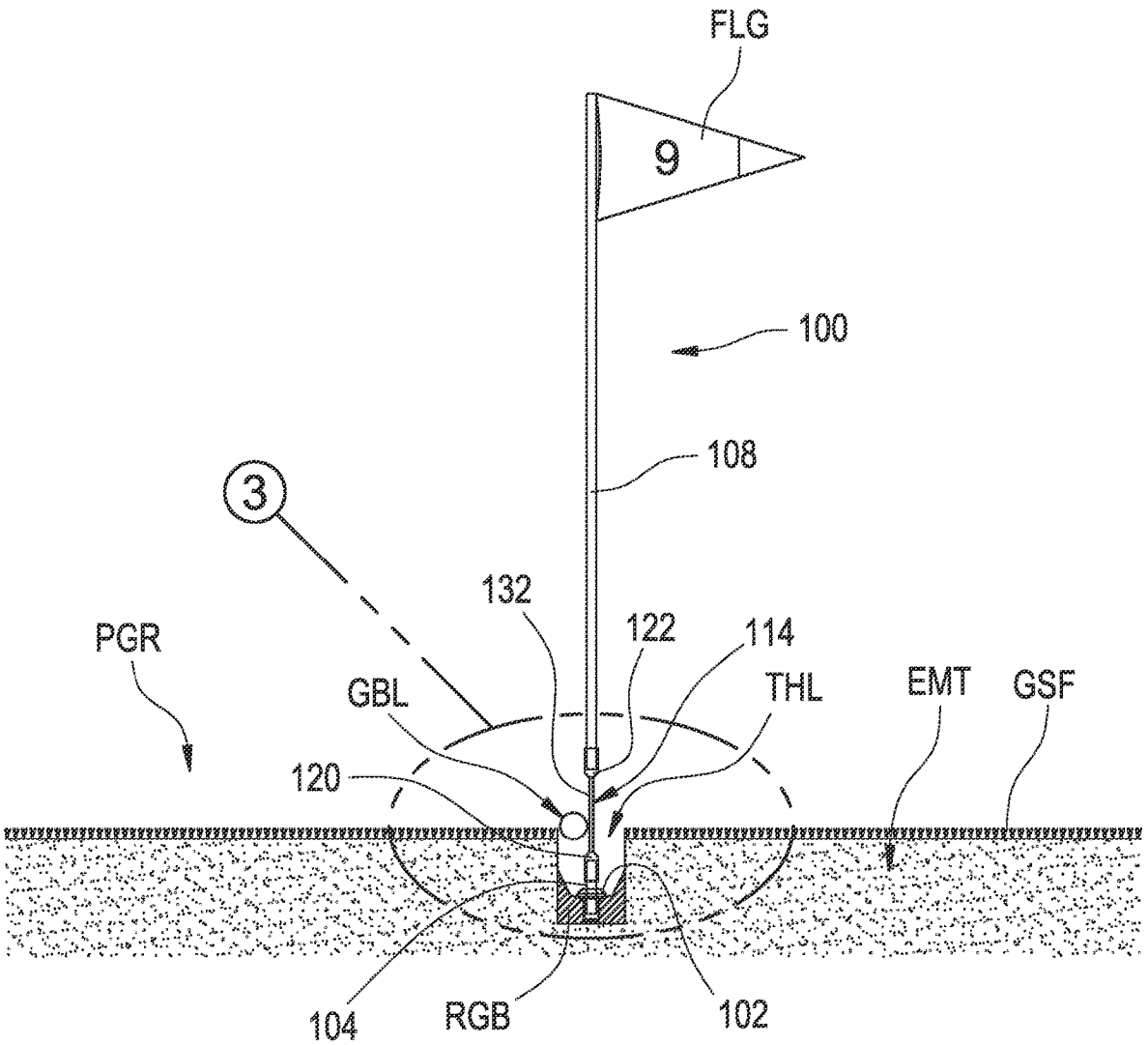
FIG. 2 is a side elevation view of the conventional golf green and target hole in FIG. 1 with an associated golf ball entering the target hole while one example of a flagstick assembly in accordance with the subject matter of the present disclosure is supported in the target hole.
Figure 8:
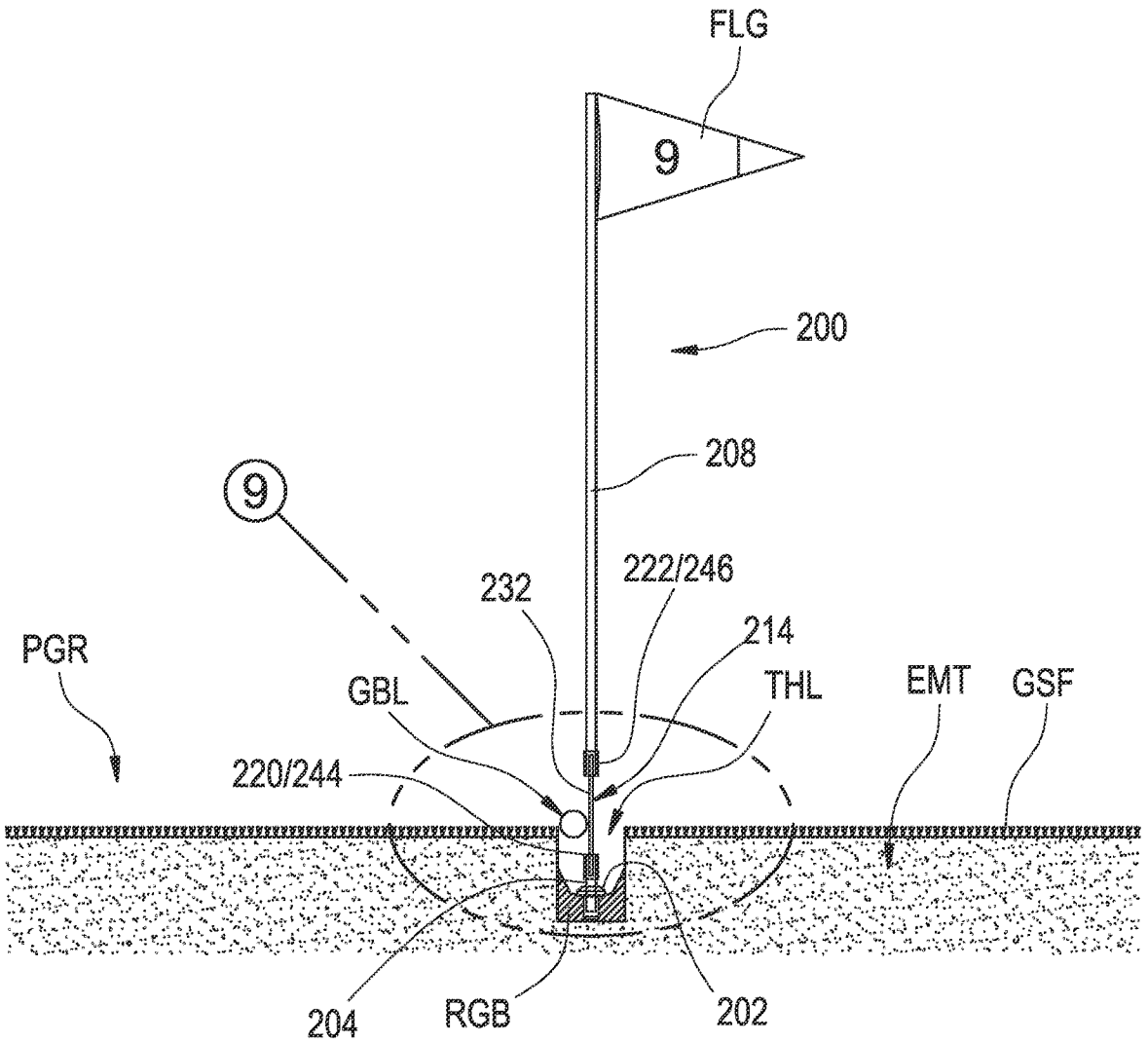
FIG. 8 is a side elevation view of the conventional golf green and target hole in FIG. 1 with an associated golf ball entering the target hole while another example of a flagstick assembly in accordance with the subject matter of the present disclosure is supported in the target hole.

Constructions of golf flagstick assemblies in accordance with the subject matter of the present disclosure are operative to minimize or at least reduce the obstruction associated with the flagstick remaining in place when a ball is played toward the target hole. In accordance with the subject matter of the present disclosure, constructions such as those disclosed herein may allow for the flagstick to provide a minimized or at least reduced area of obstruction associated with a putted ball entering target hole THL, such as is shown in FIGS. 2 and 8, for example. This reduction of area may allow for less instances of contact between golf ball GBL and the subject assemblies prior to the ball dropping into target hole THL, which contact—upon occurring—could result in a negative outcome with respect to the golf ball dropping into the hole.

In some cases, flagstick assemblies in accordance with the subject matter of the present disclosure can be constructed from new component parts. In other cases, flagstick assemblies in accordance with the subject matter of the present disclosure can be constructed from pre-existing flagsticks, such as by modifying the pre-existing flagsticks to include a connector fitting, such as is described hereinafter. One example of a golf flagstick assembly 100 in accordance with the subject matter of the present disclosure, which can be assembled from any combination of new components or a pre-existing flagstick, is shown and described herein in connection with FIGS. 2-6. Golf flagstick assembly 100 is shown in FIGS. 2 and 3 as providing additional clearance for golf ball GBL to drop into target hole THL.

Flagstick assemblies 100 can include a ferrule 102 adapted to operatively engage rigid base RGB to support flagstick assemblies 100 within target hole THL in a conventional manner. Flagstick assemblies 100 can have a longitudinal axis AX and include a flagstick portion 104 that includes an end (not numbered) disposed within or otherwise operatively connected to ferrule 102 and an end 106 opposite the ferrule. Flagstick assemblies 100 can also include a flagstick portion 108 that extends longitudinally between an end 110 disposed toward end 106 of flagstick portion 104 and an end 112 adapted to operatively engage and support flag FLG at an elevated position relative to grass surface GSF.

Figure 5:
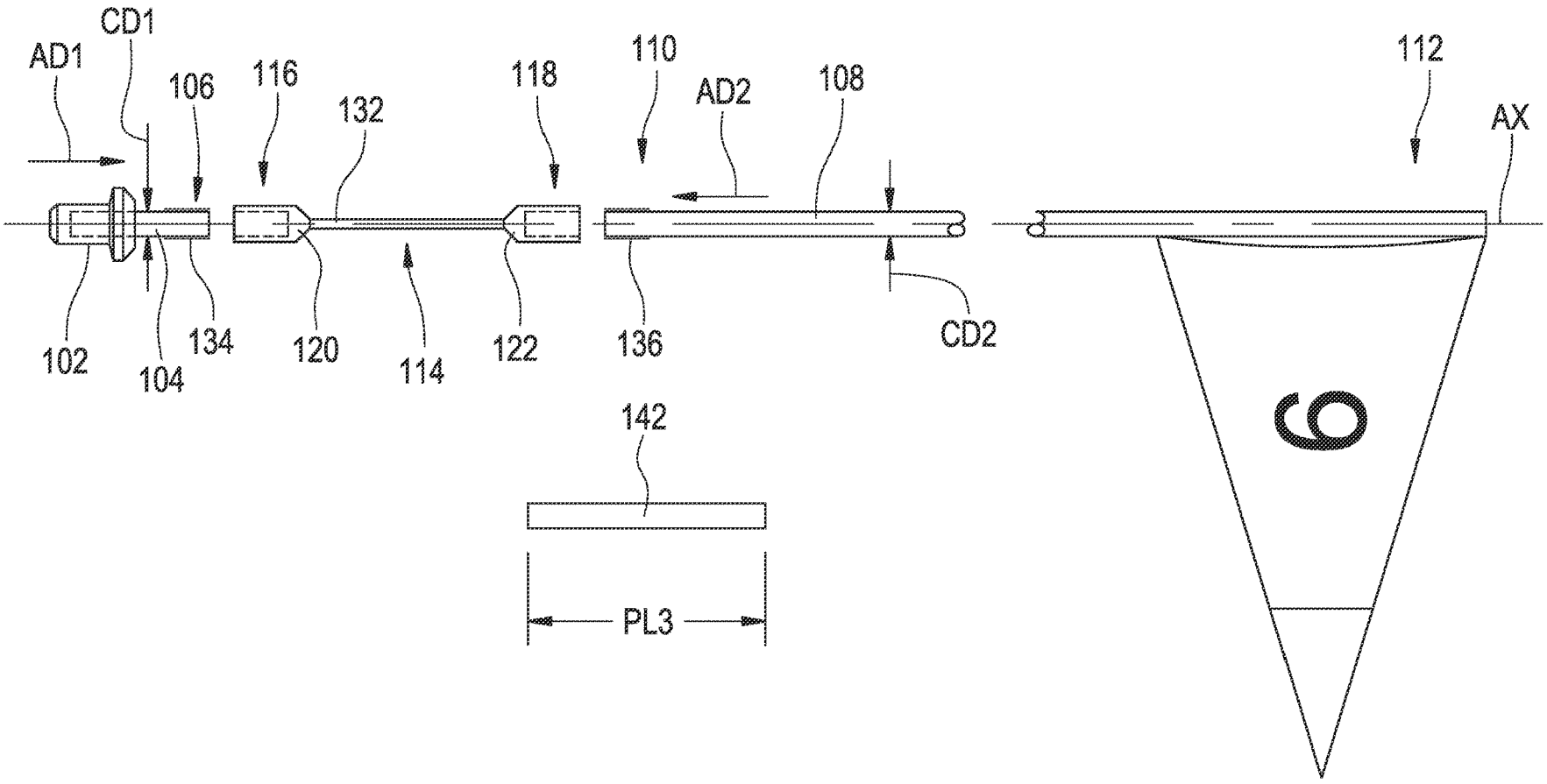
FIG. 5 is a side view of a conventional flagstick assembly undergoing modification using components and methods in accordance with the subject matter of the present disclosure.

Flagstick portion 104 can have a cross-sectional dimension taken transverse to longitudinal axis AX, as is represented in FIG. 5 by reference dimension CD1. Flagstick portion 108 can also have a cross-sectional dimension taken transverse to the longitudinal axis, as is represented in FIG. 5 by reference dimension CD2. In some cases, cross-sectional dimensions CD1 and CD2 can be approximately equal to one another. In other cases, the cross-sectional dimensions can differ from one another, such as in cases in which pre-existing flagsticks have been used that have a tapered or an otherwise varying size along the length thereof.

Figure 7:
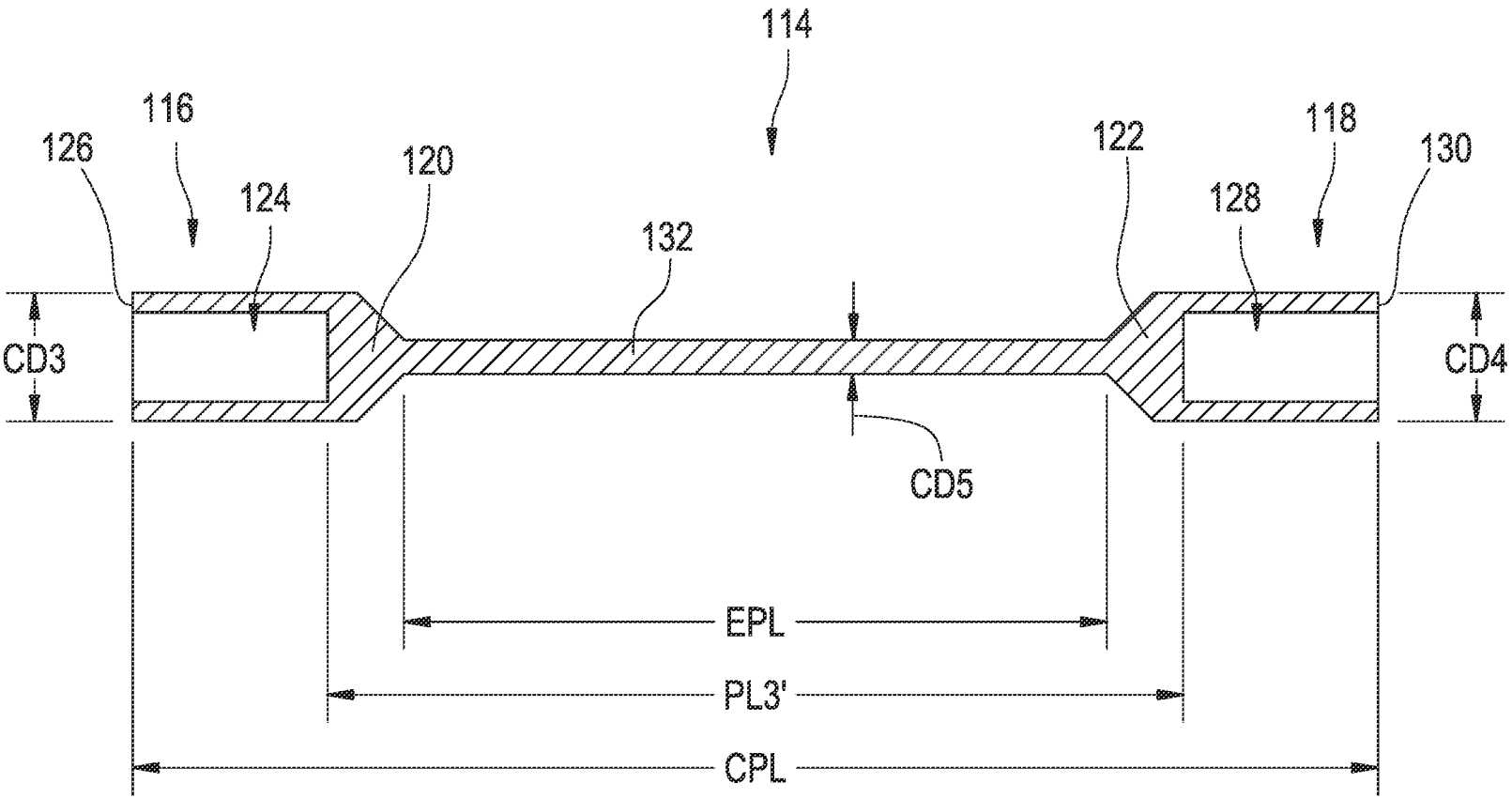
FIG. 7 is a cross-sectional side view of an exemplary flagstick component in accordance with the subject matter of the present disclosure.

A connector fitting 114 in accordance with the subject matter of the present disclosure extends between and operatively connects flagstick portions 104 and 108. Connector fitting 114 can extend lengthwise between opposing ends 116 and 118. A connector portion 120 can be included along end 116 and can be adapted for securement to end 106 of flagstick portion 104. A connector portion 122 can be included along end 118 and can be adapted for securement to end 110 of flagstick portion 108. As shown in FIG. 7, connector portion 120 and 122 can have cross-sectional dimensions taken transverse to longitudinal axis AX, as are respectively represented by reference dimensions CD3 and CD4. In some cases, cross-sectional dimensions CD3 and CD4 can be approximately equal to one another. In other cases, however, cross-sectional dimensions CD3 and CD4 can differ from one another, such as where the cross-sectional dimensions of flagstick portions 104 and 108 differ from one another, as described above. In some cases, cross-sectional dimension CD3 can be greater than cross-sectional dimensions CD1 and/or CD2. In such cases, connector portion 120 can include a recess or passage 124 that extends into the connector portion from along an end surface 126 thereof. In a preferred arrangement, recess 124 is dimensioned to receive an end of flagstick portion 104 and/or an end of flagstick portion 108. Additionally, or in the alternative, cross-sectional dimension CD4 can be greater than cross-sectional dimensions CD1 and/or CD2. In such cases, connector portion 122 can include a recess or passage 128 that extends into the connector portion from along an end surface 130 thereof. In a preferred arrangement, recess 128 is dimensioned to receive an end of flagstick portion 104 and/or an end of flagstick portion 108.

Connector fitting 114 also includes an extension portion 132 that extends longitudinally between and operatively connects connector portions 120 and 122. Extension portion 132 can have a cross-sectional dimension taken transverse to longitudinal axis AX, as is represented by reference dimension CD5 in FIG. 7. In accordance with the subject matter of the present disclosure, the cross-sectional dimension of extension portion 132 is less than cross-sectional dimension CD1 of flagstick portion 104 and/or cross-sectional dimension CD2 of flagstick portion 108. In a preferred arrangement, cross-sectional dimension CD5 can be approximately one-half or less of cross-sectional dimension CD1 and/or cross-sectional dimension CD2. In a more preferred arrangement, cross-sectional dimension CD5 can be approximately one-third or less of cross-sectional dimension CD1 and/or cross-sectional dimension CD2. As a non-limiting example, cross-sectional dimension CD5 can be within a range of approximately 0.13 inches to approximately 0.38 inches. In some cases, cross-sectional dimension CD5 can have a size of approximately 0.25 or less. Additionally, cross-sectional dimension CD5 is less than cross-sectional dimensions CD3 and/or CD4, as discussed above.

It will be appreciated that flagstick assembly 100 and connector fitting 114 thereof will undergo extended exposure to outdoor environmental conditions as well as the forces and impacts associated with regular usage in a golf course environment. In that the subject construction is intended to provide a section of the flagstick that has a minimal or at least substantially reduced diameter, it will be appreciated that connector fitting 114 can be formed from any suitable material or combination of materials capable of withstanding such forces and loads. As non-limiting examples, metal materials such as steel, titanium and/or aluminum could be used. Additionally, such material or combination of materials (and any coatings and/or treatments applied thereto) can be adapted for extended exposure to outdoor environmental conditions so as to last the lifetime of flagstick assembly 100.

It will be appreciated that connector fitting 114 can be secured to flagstick portion 104 and to flagstick portion 108 in any manner or arrangement suitable for withstanding the loads, forces, impacts and exposure discussed above. As non-limiting examples, connections utilizing a flowed-material joint, one or more mechanical fasteners and/or a mechanical interconnection could be used. Such connections are collectively represented in FIG. 5 by dashed lines 134 and 136 extending respectively along flagstick portions 104 and 108.

With respect to lengths of the various components and the positioning of extension portion 132 relative to grass surface GSF in an installed position of flagstick assembly 100, it will be appreciated that flagstick assembly 100 should be constructed such that a section 138 of extension portion 132 is disposed within target hole THL and a section 140 of extension portion 132 is disposed above or otherwise outside of the target hole. In this manner, it is ensured that a section of connector fitting 114 having a significantly reduced cross-sectional dimension (i.e., extension portion 132) is disposed along grass surface GSF such that an incoming golf ball (e.g., golf ball GBL) will contact the section of the connector fitting 114 having the significantly reduced cross-sectional dimension (i.e., extension portion 132). As a non-limiting example, extension portion 132 can have a length of at least 6 inches with section 138 extending into target hole THL at least 3 inches and section 140 disposed above or otherwise outside of the target hole at least 3 inches. In such cases, golf flagstick assembly 100 can be constructed such that there is no diameter change along the flagstick from at least 3 inches above grass surface GSF to at least 3 inches below the grass surface. In situations in which a pre-existing conventional flagstick is being modified, it may be desirable to maintain the approximate overall length of the original flagstick, as is represented in FIG. 4 by reference dimension ORL.

Figure 4:
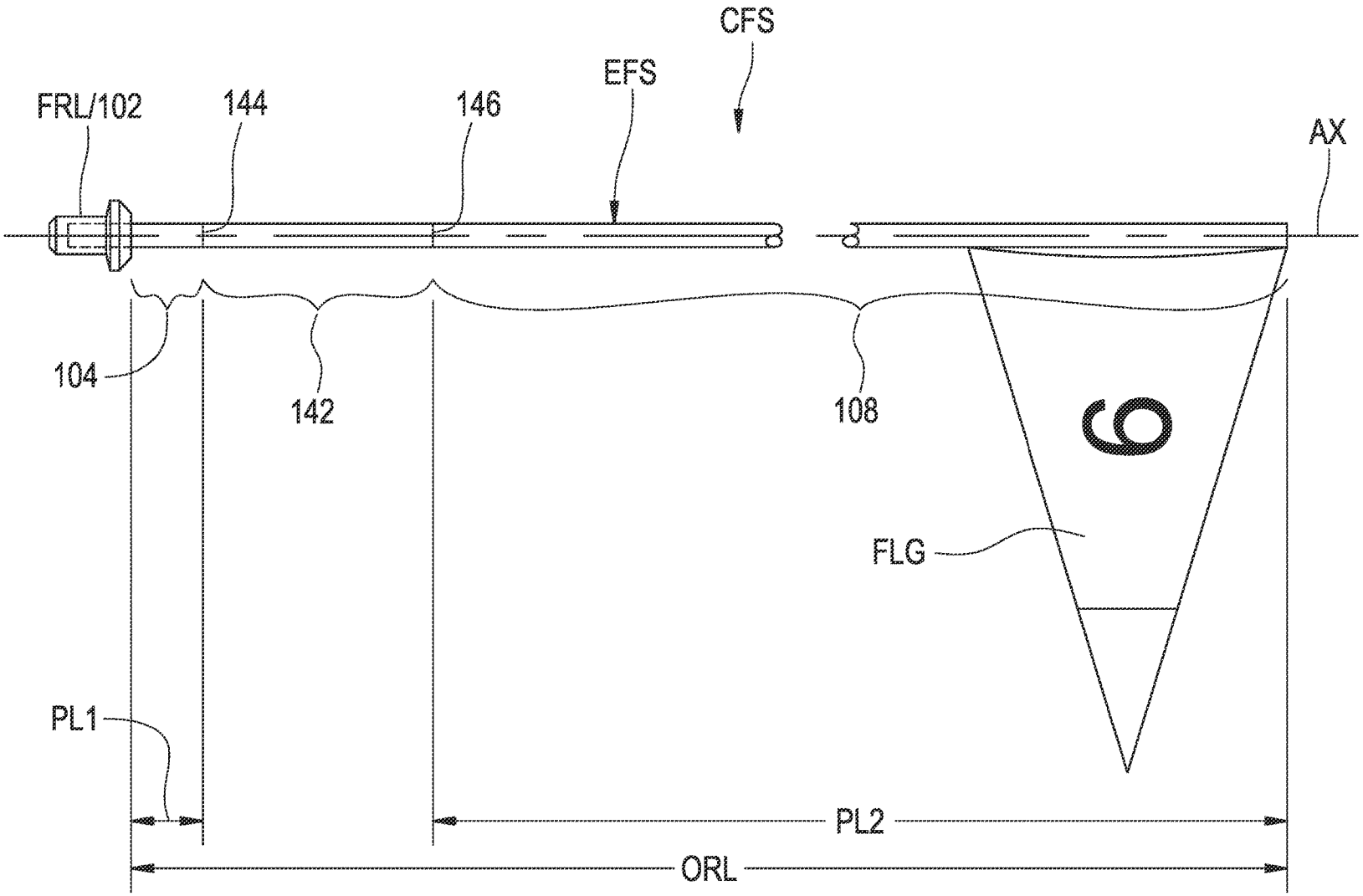
FIG. 4 is a side view of a conventional flagstick assembly prior to modification using components and methods in accordance with the subject matter of the present disclosure.
Figure 6:
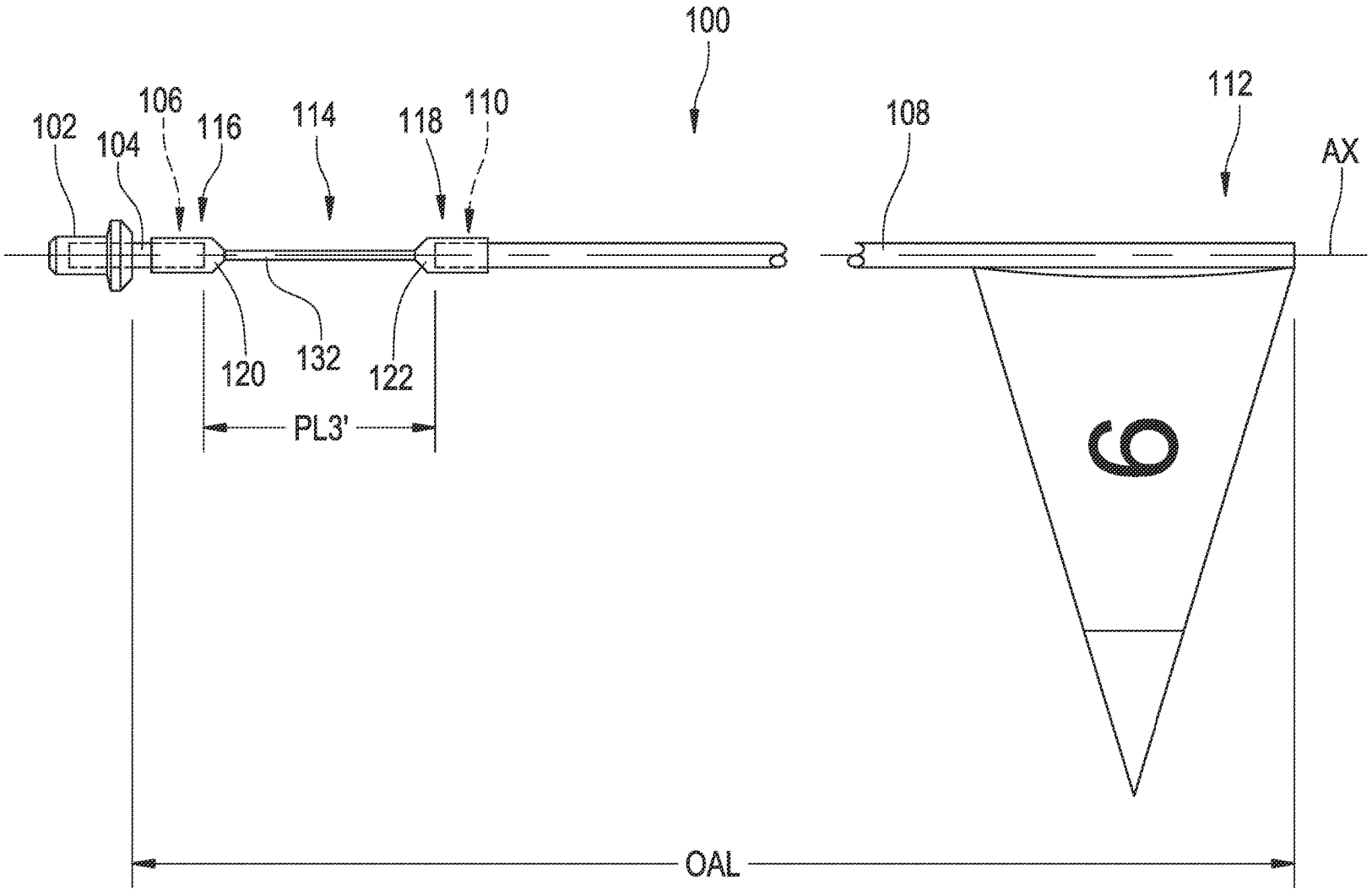
FIG. 6 is a side view of a flagstick assembly in accordance with the subject matter of the present disclosure.

One example of a method of assembling a golf flagstick assembly in accordance with the subject matter of the present disclosure can include providing a pre-existing, conventional flagstick CFS, such as is shown in FIGS. 1 and 4, for example. The exemplary method can also include separating elongated, single flagstick segment EFS into two or more flagstick portions, such as flagstick portions 104 and 108, for example. In some cases, single flagstick segment EFS can be separated into three or more portions, such as flagstick portions 104 and 108 as well as a flagstick portion 142. In such cases, one or more of the flagstick portions can be removed or otherwise eliminated from flagstick assembly 100. In the exemplary arrangement shown in FIG. 5, for example, flagstick portion 142 is removed and replaced by connector fitting 114, which has been positioned between ends 106 and 110. As is represented in FIG. 5 by arrow AD1, flagstick portion 104 and connector fitting 114 can be displaced relative to one another such that end 106 of the flagstick portion operatively engages end 116 of the connector fitting, such as by the end of the flagstick portion being at least partially received beyond end surface 126 into recess 124, such as is shown in FIGS. 2, 3 and 6, for example. Similarly, arrow AD2 can represent flagstick portion 108 and connector fitting 114 can be displaced relative to one another such that end 110 of the flagstick portion operatively engages end 118 of the connector fitting, such as by the end of the flagstick portion being at least partially received beyond end surface 130 into recess 128, such as is shown in FIGS. 2, 3 and 6, for example.

It will be appreciated that elongated flagstick segment EFS can be separated into two or more sections or portions in any suitable manner and/or through the use of any suitable technique or process, such as is represented in FIG. 4 by dashed lines 144 and/or 146. As non-limiting examples, lines 144 and/or 146 can represent separating elongated flagstick segment EFS into two or more sections or portions by cutting, sawing, shearing and/or severing. As indicated in FIGS. 4 and 5, elongated flagstick segment EFS can be separated into portions 104, 108 and, optionally, 142 having corresponding portion lengths PL1, PL2 and PL3, respectively, which at least approximately total original overall length ORL of the elongated flagstick segment. In some cases, it may be desirable to construct flagstick assembly 100 such that an overall flagstick length OAL (FIG. 6) thereof is at least approximately equal to original overall length ORL of the elongated flagstick segment. In such case, it may be desirable for flagstick portions 104 and 108 to be positioned in spaced relation to one another by approximately the length of flagstick portion 142 (i.e., length PL3). Accordingly, extension portion 132 of connector portion 114 can have an approximate length EPL that is less than length PL3, and connector portion 114 can have an overall length CPL that is greater than length PL3. In some cases, recesses 124 and/or 128 can at least partially define a distance PL3' that is approximately equal to length PL3 and at which ends 106 and 110 are disposed from one another in an assembled condition of flagstick assembly 100.

Figure 9:
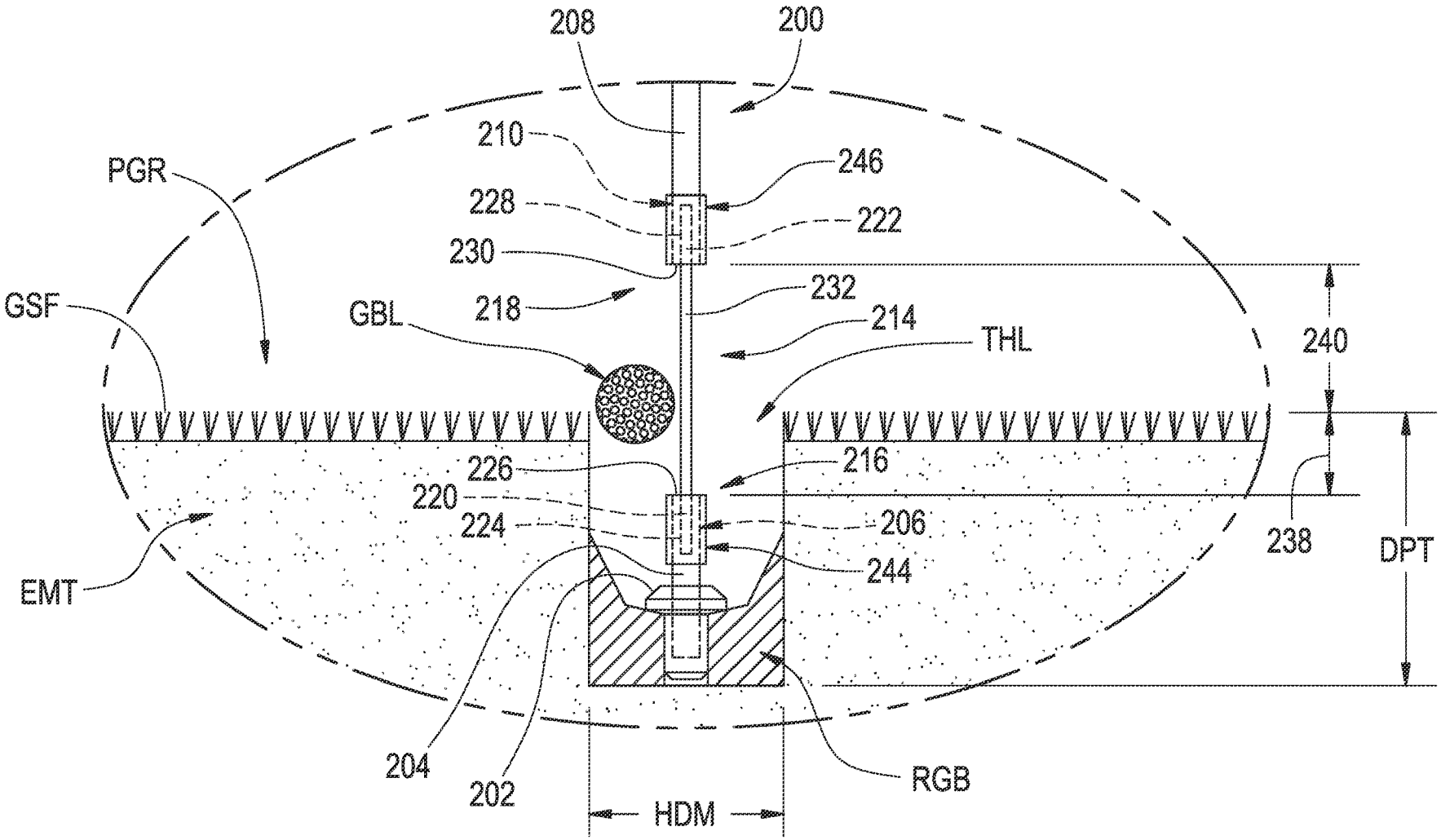
FIG. 9 is an enlarged view of the portion of the golf green and flagstick assembly identified as Detail 9 in FIG. 8.

As indicated above, flagstick assemblies in accordance with the subject matter of the present disclosure can, in some cases, be constructed from new component parts. In other cases, flagstick assemblies in accordance with the subject matter of the present disclosure can be constructed from pre-existing flagsticks, such as by modifying the pre-existing flagsticks to include a connector fitting, such as is described hereinafter. Another example of a golf flagstick assembly 200 in accordance with the subject matter of the present disclosure, which can be assembled from any combination of new components or a pre-existing flagstick, is shown and described herein in connection with FIGS. 8-13. Golf flagstick assembly 200 is shown in FIGS. 8 and 9 as providing additional clearance for golf ball GBL to drop into target hole THL.

Flagstick assemblies 200 can include a ferrule 202 adapted to operatively engage rigid base RGB to support flagstick assemblies 200 within target hole THL in a conventional manner. Flagstick assemblies 200 can have a longitudinal axis AX and include a flagstick portion 204 that includes an end (not numbered) disposed within or otherwise operatively connected to ferrule 202 and an end 206 opposite the ferrule. Flagstick assemblies 200 can also include a flagstick portion 208 that extends longitudinally between an end 210 disposed toward end 206 of flagstick portion 204 and an end 212 adapted to operatively engage and support flag FLG at an elevated position relative to grass surface GSF.

Figure 11:
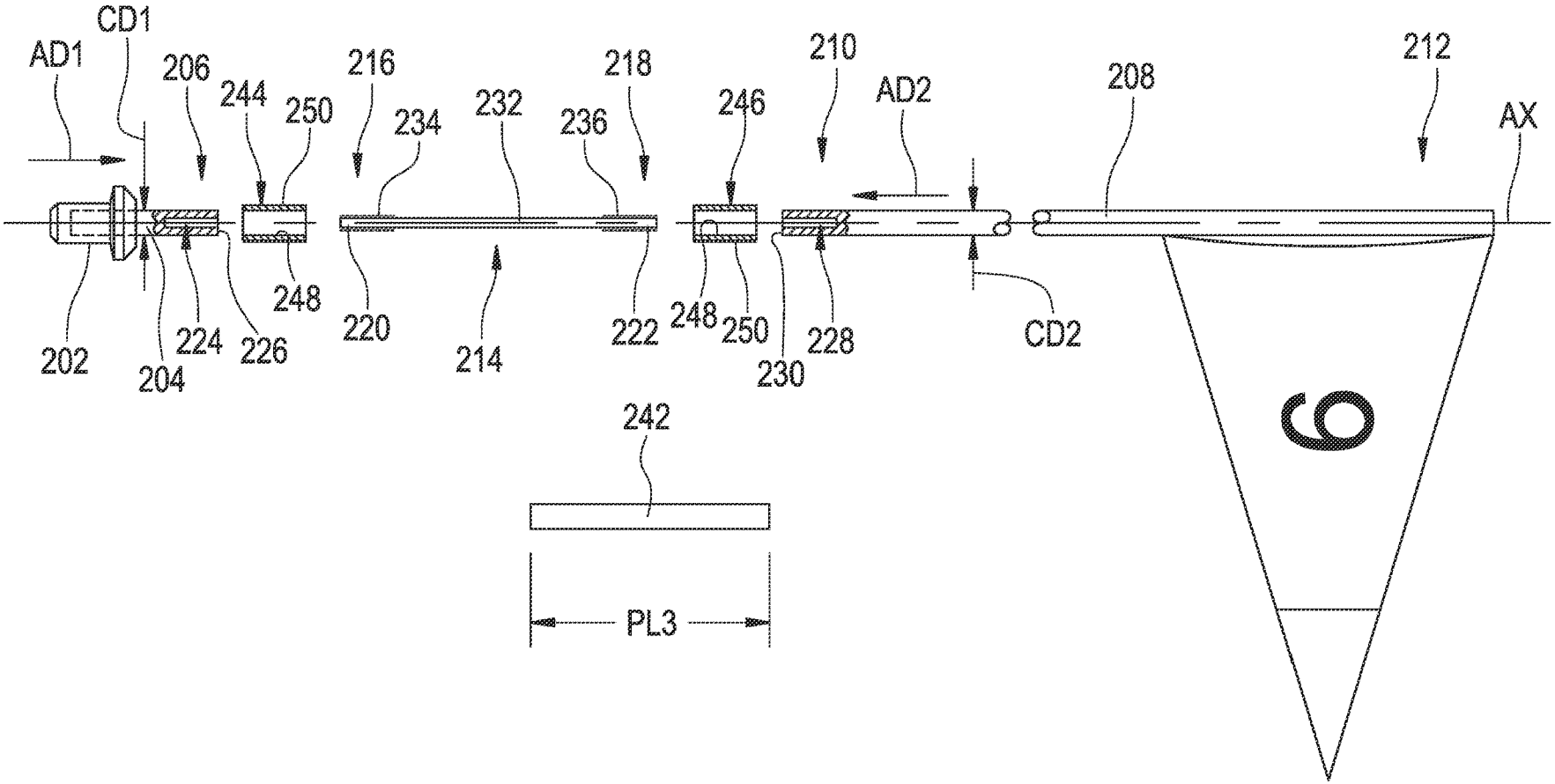
FIG. 11 is a side view of a conventional flagstick assembly undergoing modification using components and methods in accordance with the subject matter of the present disclosure.
Figure 12:
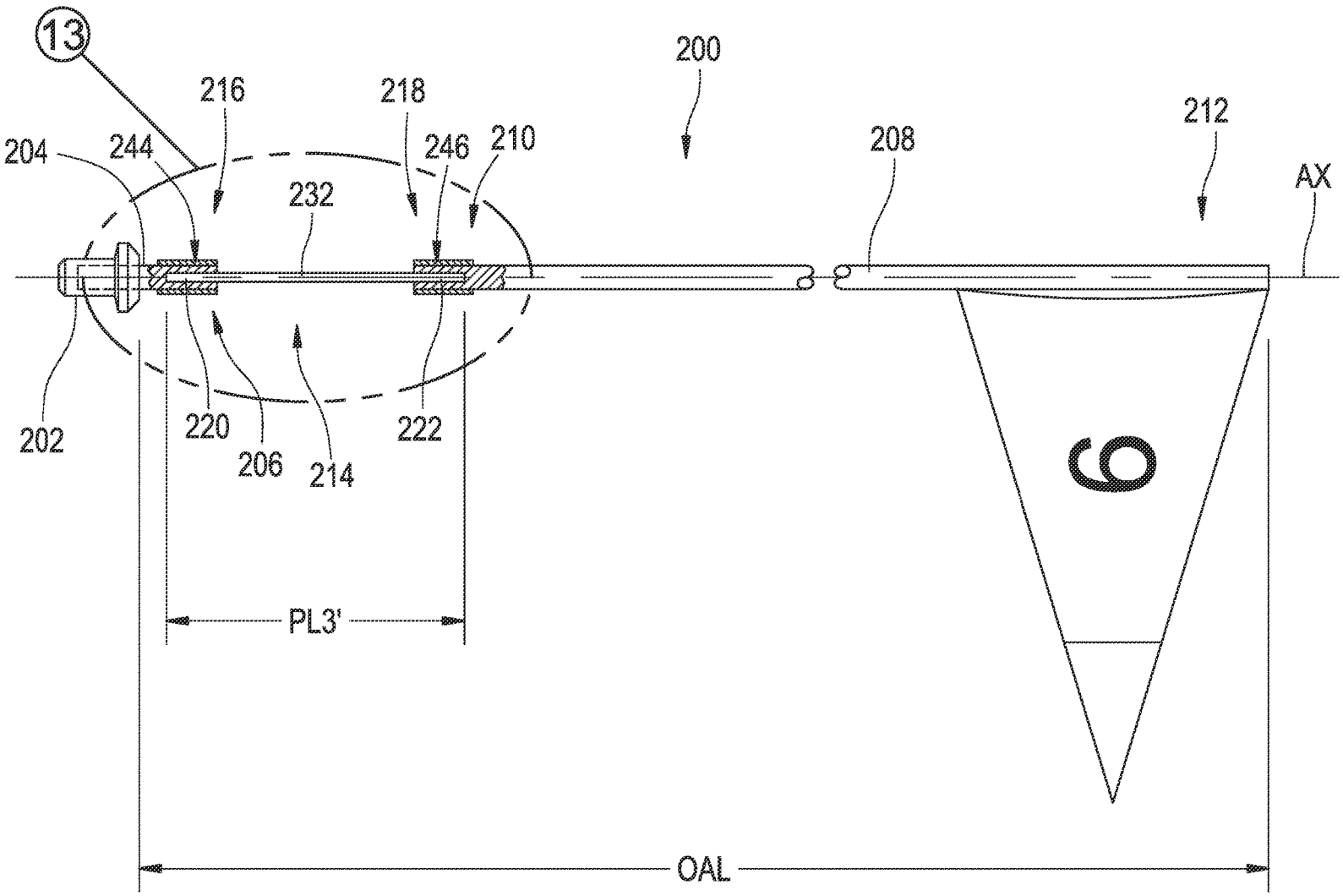
FIG. 12 is a side view of a flagstick assembly in accordance with the subject matter of the present disclosure.

Flagstick portion 204 can have a cross-sectional dimension taken transverse to longitudinal axis AX, as is represented in FIG. 11 by reference dimension CD1. Flagstick portion 208 can also have a cross-sectional dimension taken transverse to the longitudinal axis, as is represented in FIG. 11 by reference dimension CD2. In some cases, cross-sectional dimensions CD1 and CD2 can be approximately equal to one another. In other cases, the cross-sectional dimensions can differ from one another, such as in cases in which pre-existing flagsticks have been used that have a tapered or an otherwise varying size along the length thereof.

Figure 13:
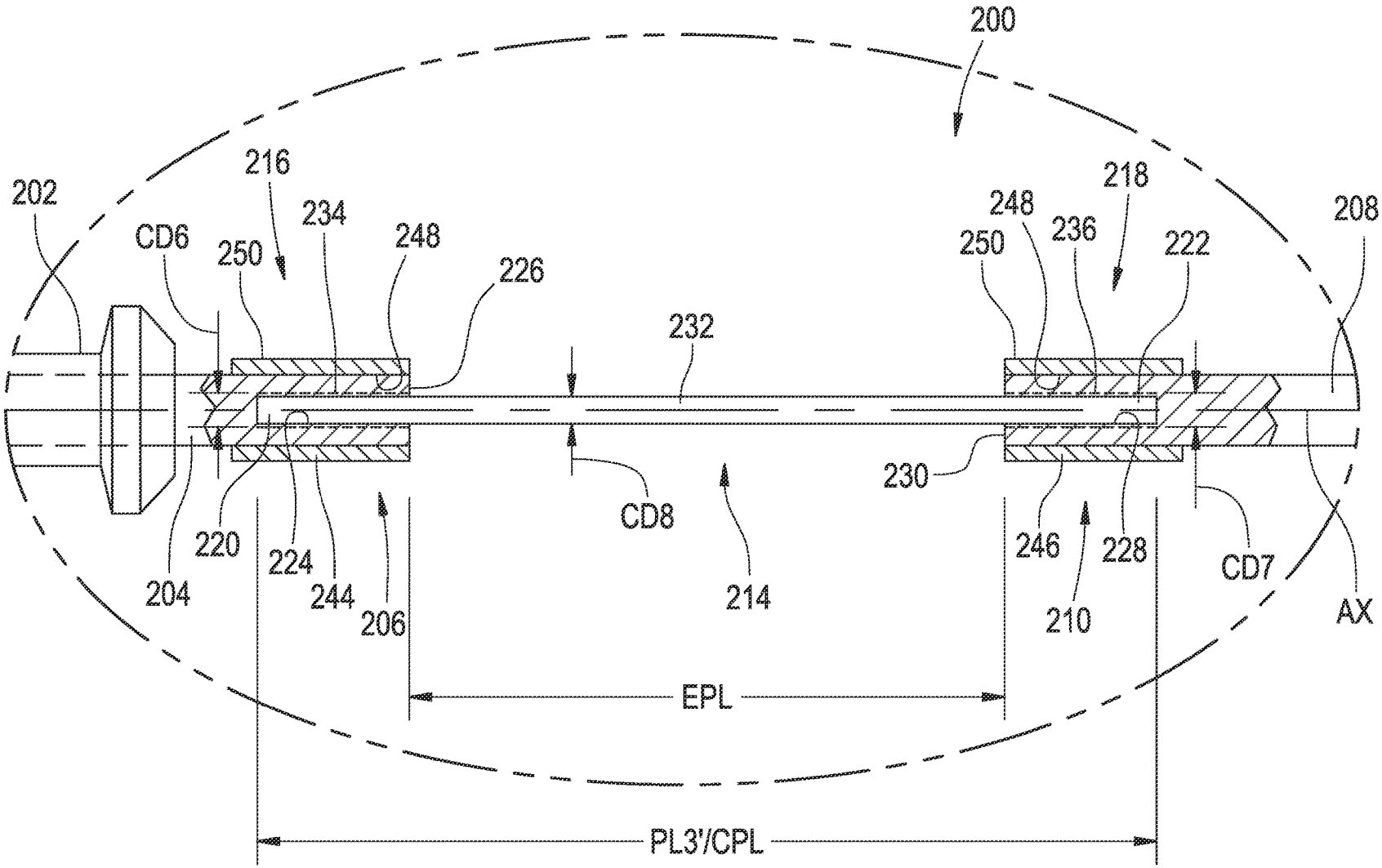
FIG. 13 is a cross-sectional side view, in partial cross section, of the portion of the flagstick assembly identified as Detail 13 in FIG. 12.

A connector fitting 214 in accordance with the subject matter of the present disclosure extends between and operatively connects flagstick portions 204 and 208. Connector fitting 214 can extend lengthwise between opposing ends 216 and 218. A connector portion 220 can be included along end 216 and can be adapted for securement to end 206 of flagstick portion 204. A connector portion 222 can be included along end 218 and can be adapted for securement to end 210 of flagstick portion 208. As shown in FIG. 13, connector portions 220 and 222 can have cross-sectional dimensions taken transverse to longitudinal axis AX, as are respectively represented by reference dimensions CD6 and CD7. In some cases, cross-sectional dimensions CD6 and CD7 can be approximately equal to one another. In other cases, however, cross-sectional dimensions CD6 and CD7 can differ from one another, such as where the cross-sectional dimensions of flagstick portions 204 and 208 differ from one another, as described above. In some cases, cross-sectional dimension CD6 can be less than cross-sectional dimensions CD1 and/or CD2. In such cases, end 206 of flagstick portion 204 can include a recess or passage 224 that extends into the flagstick portion from along an end surface 226 of flagstick portion 204. In a preferred arrangement, recess 224 is dimensioned to receive end 216 of connector fitting 214. Additionally, or in the alternative, cross-sectional dimension CD7 can be less than cross-sectional dimensions CD1 and/or CD2. In such cases, end 210 of flagstick portion 208 can include a recess or passage 228 that extends into the flagstick portion from along an end surface 230 of flagstick portion 208. In a preferred arrangement, recess 228 is dimensioned to receive end 218 of connector fitting 214.

Connector fitting 214 also includes an extension portion 232 that extends longitudinally between and operatively connects connector portions 220 and 222. Extension portion 232 can have a cross-sectional dimension taken transverse to longitudinal axis AX, as is represented by reference dimension CD8 in FIG. 13. In some cases, the cross-sectional dimension of extension portion 232 can be less than cross-sectional dimension CD1 of flagstick portion 104 and/or cross-sectional dimension CD2 of flagstick portion 108. In a preferred arrangement, cross-sectional dimension CD8 can be approximately one-half or less of cross-sectional dimension CD1 and/or cross-sectional dimension CD2. In a more preferred arrangement, cross-sectional dimension CD8 can be approximately one-third or less of cross-sectional dimension CD1 and/or cross-sectional dimension CD2. As a non-limiting example, cross-sectional dimension CD8 can be within a range of approximately 0.13 inches to approximately 0.38 inches. In some cases, cross-sectional dimension CD8 can have a size of approximately 0.25 or less. Additionally, in some cases, cross-sectional dimension CD8 can be less than cross-sectional dimensions CD6 and/or CD7. In other cases, cross-sectional dimension CD8 can be approximately equal to cross-sectional dimensions CD6 and/or CD7. In still other cases, cross-sectional dimension CD8 can be greater than cross-sectional dimensions CD6 and/or CD7.

It will be appreciated that flagstick assembly 200 and connector fitting 214 thereof will undergo extended exposure to outdoor environmental conditions as well as the forces and impacts associated with regular usage in a golf course environment. In that the subject construction is intended to provide a section of the flagstick that has a minimal or at least substantially reduced diameter, it will be appreciated that connector fitting 214 can be formed from any suitable material or combination of materials capable of withstanding such forces and loads. As non-limiting examples, metal materials such as steel, titanium and/or aluminum could be used. Additionally, such material or combination of materials (and any coatings and/or treatments applied thereto) can be adapted for extended exposure to outdoor environmental conditions so as to last the lifetime of flagstick assembly 200.

It will be appreciated that connector fitting 214 can be secured to flagstick portion 204 and to flagstick portion 208 in any manner or arrangement suitable for withstanding the loads, forces, impacts and exposure discussed above. As non-limiting examples, connections utilizing a flowed-material joint, one or more mechanical fasteners and/or a mechanical interconnection could be used. Such connections are collectively represented in FIGS. 11 and 13 by dashed lines 234 and 236 extending respectively along connector portions 220 and 222 as well as along flagstick portions 204 and 208.

With respect to lengths of the various components and the positioning of extension portion 232 relative to grass surface GSF in an installed position of flagstick assembly 200, it will be appreciated that flagstick assembly 200 should be constructed such that a section 238 of extension portion 232 is disposed within target hole THL and a section 240 of extension portion 232 is disposed above or otherwise outside of the target hole. In this manner, it is ensured that a section of connector fitting 214 having a significantly reduced cross-sectional dimension (i.e., extension portion 232) is disposed along grass surface GSF such that an incoming golf ball (e.g., golf ball GBL) will contact the section of the connector fitting 214 having the significantly reduced cross-sectional dimension (i.e., extension portion 232). As a non-limiting example, extension portion 232 can have a length of at least 6 inches with section 238 extending into target hole THL at least 3 inches and section 240 disposed above or otherwise outside of the target hole at least 3 inches. In such cases, golf flagstick assembly 200 can be constructed such that there is no diameter change along the flagstick from at least 3 inches above grass surface GSF to at least 3 inches below the grass surface. In situations in which a pre-existing conventional flagstick is being modified, it may be desirable to maintain the approximate overall length of the original flagstick, as is represented in FIG. 10 by reference dimension ORL.

Figure 10:
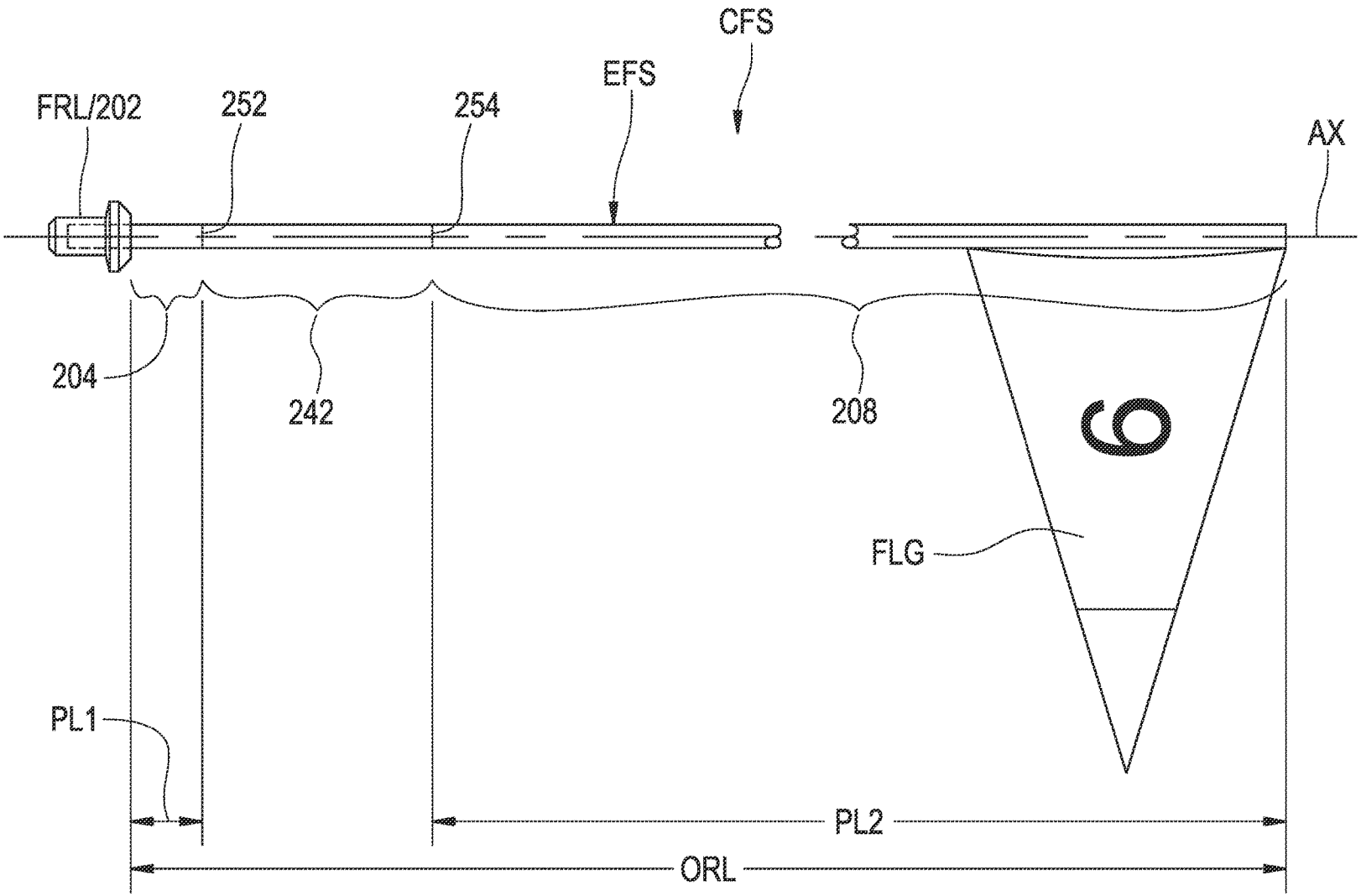
FIG. 10 is a side view of a conventional flagstick assembly prior to modification using components and methods in accordance with the subject matter of the present disclosure.

Another example of a method of assembling a golf flagstick assembly in accordance with the subject matter of the present disclosure can include providing a pre-existing, conventional flagstick CFS, such as is shown in FIGS. 1 and 10, for example. The exemplary method can also include separating elongated, single flagstick segment EFS into two or more flagstick portions, such as flagstick portions 204 and 208, for example. In some cases, single flagstick segment EFS can be separated into three or more portions, such as flagstick portions 204 and 208 as well as a flagstick portion 242. In such cases, one or more of the flagstick portions can be removed or otherwise eliminated from flagstick assembly 200. In the exemplary arrangement shown in FIG. 11, for example, flagstick portion 242 is removed and replaced by connector fitting 214, which has been positioned between ends 206 and 210. An exemplary method in accordance with the subject matter of the present disclosure can also include providing a passage or recess (e.g., recesses 224) extending into flagstick portions 204 and/or 208, such as from along end surfaces 226 thereof, for example. It will be appreciated that, in some cases, such passages or recesses may be pre-existing in flagstick portions 204 and/or 208. In such cases, the exemplary method can include sizing or resizing any such existing passages or recesses. In either of such cases, the passages or recesses are preferably dimensioned to cooperatively receive a corresponding one of connector portions 220 and 222 of connector fitting 214 in a suitable manner, such as may facilitate the formation of a flowed-material joint and/or a mechanical interconnection, for example.

As is represented in FIG. 11 by arrow AD1, flagstick portion 204 and connector fitting 214 can be displaced relative to one another such that end 206 of the flagstick portion operatively engages end 216 of the connector fitting, such as by connector portion 220 being at least partially received beyond end surface 226 into recess 224 of flagstick portion 204 as is shown in FIGS. 8, 9, 12 and 13, for example. Similarly, arrow AD2 can represent flagstick portion 208 and connector fitting 214 being displaced relative to one another such that end 210 of the flagstick portion operatively engages end 218 of the connector fitting, such as by connector portion 222 being at least partially received beyond end surface 226 into recess 224 of flagstick portion 208 as is shown in FIGS. 8, 9, 12 and 13, for example.

In some cases, flagstick assembly 200 can also include one or more connector sleeves 244 and/or 246 disposed on or along flagstick portions 204 and/or 208, respectively. If included, the one or more connector sleeves can provide additional radial support to any connection or joint formed between connector fitting 214 and the corresponding flagstick portions. In some cases, connector sleeves 244 and/or 246 can have a press, transition or clearance fit with the respective one of flagstick portions 204 and/or 208. In such cases, a flowed-material and/or mechanical connection or joint (e.g., crimped or swaged arrangement) can also, optionally, be formed between the connector sleeve and the corresponding flagstick portion. In the arrangement shown in FIGS. 8, 9 and 13, it will be recognized that connector sleeve 244 and connector portion 220 are axially co-extensive along flagstick portion 204. Additionally, or in the alternative, connector sleeve 246 and connector portion 222 can be axially co-extensive along flagstick portion 208. Connector sleeves 244 and/or 246 can include inner surfaces 248 and outer surfaces 250, and can include a longitudinal length extending between opposing end surfaces (not numbered). The connector sleeves can have inner cross-sectional dimensions and/or outer cross-sectional dimensions. In some cases, the inner cross-sectional dimensions can be at least approximately the same for connector sleeves 244 and 246, and/or the outer cross-sectional dimensions can be at least approximately the same for the connector sleeves. In other cases, connector sleeve 244 can have an inner cross-sectional dimension and/or an outer cross-sectional dimension that differs from the corresponding cross-sectional dimension of connector sleeve 246.

It will be appreciated that elongated flagstick segment EFS can be separated into two or more sections or portions in any suitable manner and/or through the use of any suitable technique or process, such as is represented in FIG. 10 by dashed lines 252 and/or 254. As non-limiting examples, lines 252 and/or 254 can represent separating elongated flagstick segment EFS into two or more sections or portions by cutting, sawing, shearing and/or severing. As indicated in FIGS. 10 and 11, elongated flagstick segment EFS can be separated into portions 204, 208 and, optionally, 242 having corresponding portion lengths PL1, PL2 and PL3, respectively, which at least approximately total original overall length ORL of the elongated flagstick segment. In some cases, it may be desirable to construct flagstick assembly 200 such that an overall flagstick length OAL (FIG. 12) thereof is at least approximately equal to original overall length ORL of the elongated flagstick segment. In such case, it may be desirable for flagstick portions 204 and 208 to be positioned in spaced relation to one another by approximately the length of flagstick portion 242 (i.e., length PL3). Accordingly, extension portion 232 of connector fitting 214 can have an approximate length EPL that is less than length PL3, and connector fitting 214 can have an overall length CPL that is greater than length PL3. In some cases, in an assembled condition of the flagstick assembly, recesses 224 and 228 in ends 206 and 210 of flagstick portions 204 and 208, respectively, can at least partially define a distance PL3' that is approximately equal to overall length CPL of the connector fitting such that the overall flagstick length OAL (FIG. 12) thereof is at least approximately equal to original overall length ORL of the elongated flagstick segment.

As used herein with reference to certain features, elements, components and/or structures, numerical ordinals (e.g., first, second, third, fourth, etc.) may be used to denote different singles of a plurality or otherwise identify certain features, elements, components and/or structures, and do not imply any order or sequence unless specifically defined by the claim language. Additionally, the terms "transverse," and the like, are to be broadly interpreted. As such, the terms "transverse," and the like, can include a wide range of relative angular orientations that include, but are not limited to, an approximately perpendicular angular orientation. Also, the terms "circumferential," "circumferentially," and the like, are to be broadly interpreted and can include, but are not limited to circular shapes and/or configurations. In this regard, the terms "circumferential," "circumferentially," and the like, can be synonymous with terms such as "peripheral," "peripherally," and the like.

Furthermore, the phrase "flowed-material joint" and the like, if used herein, are to be interpreted to include any joint or connection in which a liquid or otherwise flowable material (e.g., a melted metal or combination of melted metals) is deposited or otherwise presented between adjacent component parts and operative to form a fixed and substantially fluid-tight connection therebetween. Examples of processes that can be used to form such a flowed-material joint include, without limitation, welding processes, brazing processes and soldering processes. In such cases, one or more metal materials and/or alloys can be used to form such a flowed-material joint, in addition to any material from the component parts themselves. Another example of a process that can be used to form a flowed-material joint includes applying, depositing or otherwise presenting an adhesive between adjacent component parts that is operative to form a fixed and substantially fluid-tight connection therebetween. In such case, it will be appreciated that any suitable adhesive material or combination of materials can be used, such as one-part and/or two-part epoxies, for example.

It will be recognized that numerous different features and/or components are presented in the embodiments shown and described herein, and that no one embodiment may be specifically shown and described as including all such features and components. As such, it is to be understood that the subject matter of the present disclosure is intended to encompass any and all combinations of the different features and components that are shown and described herein, and, without limitation, that any suitable arrangement of features and components, in any combination, can be used. It is to be distinctly understood claims directed to any such combination of features and/or components, whether or not specifically embodied herein, are intended to find support in the present disclosure.

While the subject matter of the present disclosure has been described with reference to the foregoing embodiments and considerable emphasis has been placed herein on the structures and structural interrelationships between the component parts of the embodiments disclosed, it will be appreciated that other embodiments can be made and that many changes can be made in the embodiments illustrated and described without departing from the principles hereof. Obviously, modifications and alterations will occur to others upon reading and understanding the preceding detailed description. Accordingly, it is to be distinctly understood that the foregoing descriptive matter is to be interpreted merely as illustrative of the subject matter of the present disclosure and not as a limitation. As such, it is intended that the subject matter of the present disclosure be construed as including all such modifications and alterations.

The invention claimed is:

1. A golf flagstick assembly dimensioned to be supported within an associated base located within an associated target hole, said golf flagstick assembly having a longitudinal axis and comprising:

a ferrule dimensioned to operatively engage the associated base;

a first flagstick portion including a first end operatively connected to said ferrule and a second end spaced apart from said ferrule, said first flagstick portion having a first cross-sectional dimension transverse to said longitudinal axis;

a second flagstick portion including a first end and a second end spaced apart from said first end, said second flagstick portion being separate from said first flagstick portion and having a second cross-sectional dimension transverse to said longitudinal axis, said second flagstick portion oriented such that said first end of said second flagstick portion is disposed toward said second end of said first flagstick portion; and, a connector fitting extending between and rigidly connecting said first and second flagstick portions, said connector fitting having a fitting cross-sectional dimension transverse to said longitudinal axis that is less than said first cross-sectional dimension of said first flagstick portion and said second cross-sectional dimension of said second flagstick portion.

2. A golf flagstick assembly according to claim 1, wherein said connector fitting has an overall fitting length and includes an extension portion having said fitting cross-sectional dimension with said extension portion having an extension portion length that is less than said overall fitting length.

3. A golf flagstick assembly according to claim 2, wherein said connector fitting has a first connector portion extending from said extension portion with said first connector portion having a first connector cross-sectional dimension transverse to said longitudinal axis that is greater than said fitting cross-sectional dimension.

4. A golf flagstick assembly according to claim 3, wherein said first connector portion is secured to said second end of said first flagstick portion.

5. A golf flagstick assembly according to claim 4, wherein said first connector portion includes a recess dimensioned to at least partially receive said second end of said first flagstick portion.

6. A golf flagstick assembly according to claim 5, wherein said second end of said first flagstick portion is secured within said recess of said first connector portion using a flowed-material joint, a mechanical fastener and/or a mechanical interconnection.

7. A golf flagstick assembly according to claim 2, wherein said connector fitting has a second connector portion extending from said extension portion with said second connector portion having a second connector cross-sectional dimension transverse to said longitudinal axis that is greater than said fitting cross-sectional dimension.

8. A golf flagstick assembly according to claim 7, wherein said second connector portion is secured to said first end of said second flagstick portion.

9. A golf flagstick assembly according to claim 8, wherein said second connector portion includes a recess dimensioned to at least partially receive said first end of said second flagstick portion.

10. A golf flagstick assembly according to claim 9, wherein said first end of said second flagstick portion is secured within said recess of said second connector portion using a flowed-material joint, a mechanical fastener and/or a mechanical interconnection.

11. A golf flagstick assembly according to claim 1, wherein said connector fitting is disposed in spaced relation to said ferrule such that a portion of said connector fitting is disposed within the associated target hole and a portion of said connector fitting is disposed outside of the associated target hole.

12. A golf flagstick assembly according to claim 1 further comprising a flag supported on said second end of said second portion of said flagstick.

13. A method of assembling a golf flagstick, said method comprising:

providing a first flagstick portion and a second flagstick portion that is separate from said first flagstick portion, said first flagstick portion having a first cross-sectional dimension and said second flagstick portion having a second cross-sectional dimension;

providing a connector fitting formed from a metal material, said connector fitting including a first connector portion, a second connector portion, and an extension portion extending longitudinally between and rigidly connecting said first and second connector portions, said extension portion having an extension cross-sectional dimension within a range of from approximately 0.13 inches to approximately 0.38 inches such that said extension cross-sectional dimension is less than said first cross-sectional dimension of said first flagstick portion and less than said second cross-sectional dimension of said second flagstick portion;

securing said first flagstick portion to said first connector portion of said connector fitting; and, securing said second flagstick portion to said second connector portion of said connector fitting such that said extension portion is positioned lengthwise between said first and second flagstick portions.

14. A method of assembling a golf flagstick according to claim 13, wherein providing said connector fitting includes providing said first connector portion with a recess dimensioned to at least partially receive said first flagstick portion.

15. A method of assembling a golf flagstick according to claim 14, wherein providing said connector fitting includes providing said second connector portion with a recess dimensioned to at least partially receive said second flagstick portion.

16. A golf flagstick assembly according to claim 1, wherein said connector fitting is formed from a metal material selected from the group consisting of steel, titanium, and aluminum.

17. A golf flagstick assembly dimensioned to be supported within an associated base located within an associated target hole, said golf flagstick assembly having a longitudinal axis and comprising:

a ferrule dimensioned to operatively engage the associated base;

a first flagstick portion including a first end operatively connected to said ferrule and a second end spaced apart from said ferrule, said first flagstick portion having a first cross-sectional dimension of at least approximately 0.50 inches in a direction transverse to said longitudinal axis;

a second flagstick portion including a first end and a second end spaced apart from said first end, said second flagstick portion being separate from said first flagstick portion and having a second cross-sectional dimension of at least approximately 0.50 inches in a direction transverse to said longitudinal axis, said second flagstick portion oriented such that said first end of said second flagstick portion is disposed toward said second end of said first flagstick portion; and, a connector fitting formed from a metal material, said connector fitting including a first connector portion, a second connector portion and an extension portion rigidly interconnecting said first and second connector portions, said first connector portion secured to said second end of said first flagstick portion, said second connector portion secured to said first end of said second flagstick portion, said extension portion having an extension-portion cross-sectional dimension transverse to said longitudinal axis, said extension-portion cross-sectional dimension being within a range of from approximately 0.13 inches to approximately 0.38 inches such that said extension-portion cross-sectional dimension is less than said first cross-sectional dimension of said first flagstick portion and said second cross-sectional dimension of said second flagstick portion.

18. A golf flagstick assembly according to claim 17, wherein said metal material is steel, titanium, or aluminum.

19. A golf flagstick assembly according to claim 17, wherein said extension portion has a length of at least approximately 6 inches.

20. A golf flagstick assembly according to claim 19, wherein said connector fitting is disposed in spaced relation to said ferrule such that at least a first section of said extension portion having a length of at least approximately 3 inches is disposed within the associated target hole and a second section of said extension portion having a length of approximately 3 inches is disposed outside of the associated target hole.

* * * * *